US007140847B2

(12) United States Patent
Boger et al.

(10) Patent No.: US 7,140,847 B2
(45) Date of Patent: Nov. 28, 2006

(54) INTEGRATED HIGH VACUUM PUMPING SYSTEM

(75) Inventors: Michael S. Boger, Corvallis, OR (US); Daimhin Paul Murphy, San Francisco, CA (US); Christopher M. Bailey, Pleasanton, CA (US); Yoshihiro Enomoto, Narashino (JP)

(73) Assignee: The BOC Group, Inc., Murray Hill, NJ (US)

( * ) Notice: Subject to any disclaimer, the term of this patent is extended or adjusted under 35 U.S.C. 154(b) by 265 days.

(21) Appl. No.: 10/916,081

(22) Filed: Aug. 11, 2004

(65) Prior Publication Data

US 2006/0034715 A1 Feb. 16, 2006

(51) Int. Cl.
*F04B 49/00* (2006.01)

(52) U.S. Cl. ..... 417/296; 417/423.4; 417/423.14

(58) Field of Classification Search ..... 417/423.4, 417/423.14, 440, 296
See application file for complete search history.

(56) References Cited

U.S. PATENT DOCUMENTS

| | | | | |
|---|---|---|---|---|
| 3,096,785 | A | 7/1963 | Hornschuch | |
| 3,151,806 | A | 10/1964 | Whitfield | |
| 4,171,936 | A | 10/1979 | Hageman et al. | |
| 4,734,018 | A * | 3/1988 | Taniyama et al. | 417/423.4 |
| 4,990,066 | A | 2/1991 | Kern | |
| 5,924,841 | A * | 7/1999 | Okamura et al. | 415/90 |
| 6,089,537 | A | 7/2000 | Olmsted | |
| 6,161,576 | A | 12/2000 | Maher et al. | |
| 6,168,390 | B1 | 1/2001 | Hunklinger et al. | |
| 6,676,384 | B1 | 1/2004 | Eberl | |
| 2003/0113215 | A1 | 6/2003 | Choi et al. | |
| 2005/0042118 | A1 * | 2/2005 | Sekiguchi et al. | 417/423.4 |
| 2006/0140795 | A1 * | 6/2006 | Schofield | 417/423.4 |

FOREIGN PATENT DOCUMENTS

JP 404001481 A 1/1992

OTHER PUBLICATIONS

Mishima et al.; English Abstract of JP 404001481 A entitled Evacuation Mechanism in Vacuum Vessel; Jan. 6, 1992.
PCT International Search Report of International Application No. PCT/US05/27596; date of mailing of the International Search Report: Nov. 29, 2005.
Written Opinion of the International Searching Authority of PCT International Application No. PCT/US05/27596; date of mailing: Nov. 29, 2005.

* cited by examiner

*Primary Examiner*—William H. Rodriguez
(74) *Attorney, Agent, or Firm*—Ira Lee Zebrak; Mary K. Nicholes

(57) ABSTRACT

The present invention relates to the integration of a TMP with the associated bypass line and valves so that a single sub-assembly is created. The housing of the TMP is significantly modified to accommodate the associated equipment necessary for constructing a high-vacuum system.

12 Claims, 8 Drawing Sheets

INTEGRATED HIGH VACUUM PUMPING SYSTEM

FIELD OF THE INVENTION

The present invention relates to the field of pumping of gases and vapors in the field of general vacuum or in the process of semiconductor devices or display screens. More specifically, the present invention relates to an integrated high vacuum pumping system.

BACKGROUND OF THE INVENTION

In the pumping of gases and vapors, such as in the manufacture of semiconductor devices and display screens, it is often necessary to use a high vacuum pumping system. A common pump used for this purpose is a turbo-molecular pump (TMP).

The TMP, used on a wide variety of semiconductor and general applications, relies on a rotating member that rotates near the velocity of the gas molecules to be pumped. A significant feature of such a pump is that the compression ratio of outlet to inlet pressure is very high. Moreover, the exhaust of the TMP, in general, must not be subjected to too high of a pressure. In particular, the differential pressure between the inlet and the outlet of the pump must be kept low.

If the pump is subjected to high pressure, either at the inlet or exhaust, then significant heat and stress are generated within the pump. The heat and pressure can cause the pump to destroy itself. To avoid this situation, the TMP is generally used within a vacuum system that incorporates a bypass line and some control logic to ensure that the pump is operated only when both the inlet and exhaust pressure is initially low.

A typical vacuum system will have a chamber where a process or experiment is to occur, a bypass line with a valve near the inlet to the chamber, a TMP with a valve connected to the exhaust of the TMP, and a valve connected between the inlet of the TMP and the chamber. The exhaust of the TMP, via a valve, is connected to the downstream side of the bypass line.

The bypass line, used in conjunction with valves both on the inlet and the exhaust of the pump, is used to evacuate the chamber to which the TMP is attached. A secondary pump, or backing pump, performs the evacuation. Once the chamber pressure is beneath a certain threshold amount, determined by the design of the TMP, the valve connecting the bypass line to the chamber is closed. Then, the exhaust valve to the TMP is opened and subsequently the valve to the inlet of the TMP is opened. A fluidic connection is now made between the chamber and the backing pump via the inlet valve to the TMP, the TMP itself, and the exhaust valve of the TMP. The TMP now continues to evacuate the chamber.

Due to the intrinsic nature of the TMP vacuum performance, all TMPs require some form of bypass line, bypass valve, inlet valve, and exhaust valve. There are generally some additional gauges connected, for example a pressure gauge or vacuum switch, connected to various points within the vacuum system to monitor its performance and generate signals to external, remote or closely mounted, controllers that actuate the valves.

The aforementioned vacuum systems are assembled from various components, for example, air-actuated solenoid vacuum valves, pipes, vacuum seals, throttle valves, gate valves, TMP, and the like. A key feature of this system is that there is universally an assembly of the various components with multiple seals and connections. Conventionally, there is limited integration of the components.

The aforementioned known vacuum systems find frequent use in the manufacture of semiconductor devices, for example, in etching processes or in high-density plasma chemical vapor deposition processes. In these processes, there are process gases introduced into the chamber that are subsequently pumped through the vacuum system (the TMP and valve assembly). There are several important aspects that are considered in the design of a vacuum system for use in processing including thermal management of the vacuum system, process control through-flow conductance variations, compatibility of the components with the process gases, the amount of total space physically occupied by the vacuum system and the proportions of this space, and the serviceability of the vacuum system.

Thermal management of the vacuum system is critical to some processes. In some processes, the vacuum lines, valves, and TMP are heated to a certain temperature to prevent both corrosion and condensation of the gases onto any of the surfaces in contact with the fluids. Any condensation will create not only solids (by definition), but also a source of particle impurity. Elements of the condensation can separate and find themselves within the gas stream being pumped. These particles can back-stream against the flow of the process gases and land onto the wafer substrate being processed, or other item within the chamber of interest. For semiconductor processing in particular, the separation between critical circuit components and connections on the wafer can be many times smaller than the particle that lands on the device, thus rendering the device on the wafer useless.

The mechanism of particle generation is a central point of focus in semiconductor processing. Despite the attention, the fundamental mechanism of particle generation is not fully understood. Nonetheless, temperature differentials, moving parts within the gas stream, and material composition all can exacerbate cleanliness issues.

In the vacuum systems used today there are temperature differentials created through the use of separate thermal management systems applied to the bypass line, the various valves, and the TMP. For example, the valve to the inlet of the pump, typically a gate valve, throttle-valve, or combination throttle and gate valve, is usually fitted with some sort of heater to raise the temperature of the components. The TMP will also be fitted with a heater to keep its internal components warm. It is quite common for these temperatures to be different, thus creating a temperature gradient. Moreover, the bypass valve and TMP exhaust valve are also heated. Again, the temperatures of the valves may not be the same, and they will be different from that of the TMP. These temperature gradients can exacerbate a particle formation problem.

Another key element to a vacuum system used for processing is having a method of process control. This is normally accomplished by using a valve to the inlet of the TMP. The inlet valve, or valves, to the TMP typically perform two functions, isolation and variation of the flow conductance. Such inlet valves are referred to as gate valves or throttling valves depending upon their function. These functions can be performed by either one valve or by two separate valves. It is increasingly common to use a single valve to perform both functions. The inlet valve, a separate but necessary component to the vacuum system, can be of various types, one such type is a pendulum-type. This separate valve is connected to the inlet of the TMP through a vacuum seal and a means of clamping, such as bolts. The valve itself is connected to the vacuum-processing chamber through a similar interface.

The valve body itself serves various functions. One function is to support the weight of the TMP through connection to the chamber. Another function is to provide a vacuum seal to both the TMP and chamber, which entails precise machining and the use of special-material vacuum seals. A third function is to have sufficient strength to withstand the torque that can be generated in the event of catastrophic rotor destruction.

A further important element to a vacuum system used for processing is that of selecting the correct components that will comprise the vacuum system. Subtle discrepancies in component specification can result in premature failure of the system. For example, the incorrect use of a single vacuum seal with the wrong material in a fluorine-based process can cause a leak of the process gas, that is typically toxic or corrosive, and therefore cause a risk to health. Moreover, for reliability purposes, it is advantageous to reduce the number of seals used if at all possible to reduce the chance of incorrect application and design. The burden of selecting the correct components and methods of assembly lies with the design engineer. Due to the number of components, the engineering task can be complicated and time-consuming.

Yet another key element to a vacuum system used for processing is that of conserving the amount of space used by the vacuum system. In all processes, it is economically beneficial to reduce the amount of space occupied by a vacuum processing tool and the space occupied by the ancillary equipment required to make the process work well. In semiconductor processing applications, for example, the amount of space under the process tool, where the high-vacuum system is normally arranged (or at least a portion of such), is precious due to the large amount of equipment whose performance could benefit by being closer to the processing chamber. In vacuum systems, the amount of "footprint" space, the area consumed by the equipment from a top-down projection, is important. For example, it is important to arrange the vacuum valves in the vacuum system to avoid obstructions with other nearby equipment. It is also desirable to keep the bypass line as close to the TMP as possible to minimize the footprint.

Still another key element to a vacuum system used for processing is minimizing the cost and time of repair and service, thus maximizing the amount of available operating time. It is also important to minimize the amount of time required to interchange faulty components (or assemblies) with new ones. Today's TMP-based vacuum systems, comprising of a number of components, require a large amount of components to be held in stock for repairs and service. It is also advantageous to have vacuum systems comprise as few components as possible to minimize the amount of stock held for service repairs and replacements.

SUMMARY OF THE INVENTION

The present invention is directed to an integrated vacuum pumping system for gas delivery comprising a housing with integral flange for connection to a process chamber, and a cavity within the housing. The cavity comprises a turbo-molecular pump (TMP). The housing also incorporates an inlet valve integrated into the housing and moveably connected to the housing. The inlet valve is located within said cavity at a position between the turbo-molecular pump and the process chamber. The housing further incorporates a bypass line integrally located within the housing. The bypass line is oriented in valved communication with the cavity at a plurality of locations along the bypass line, with at least one location being located on either side of the gate valve. A bypass valve is integrally located within the bypass line for regulating bypass flow between the cavity and the process chamber; and an exhaust valve is located integrally within the housing at a distance from the bypass valve and proximate to the cavity. By integrating the stated components into a unitary construction, the housing, the gate valve, bypass valve, exhaust valve and by pass line are maintained at substantially similar temperatures during operation.

According to a further embodiment of the present invention, a bypass valve is located within the bypass line for regulating bypass flow within said bypass line between the cavity and the process chamber; and an exhaust valve for regulating flow from the cavity to the bypass line is located proximate to said bypass valve. In one preferred embodiment, the bypass valve and the exhaust valve are combined into a three-way valve.

Still further, the present invention is directed to a method for delivering gas comprising the steps of directing a flow from a source to an apparatus for delivering gas, the apparatus comprising a housing with integral flange for connection to a process chamber, a cavity within said housing, said cavity comprising a turbo-molecular pump, an inlet valve integrated into the housing and moveably connected to the housing, said inlet valve located within said cavity at a position between the turbo-molecular pump and the process chamber, a bypass line integrally located within the housing, said bypass line in valved communication with the cavity at a plurality of locations along the bypass line, with at least one location being located on either side of the gate valve, a bypass valve located within the bypass line for regulating bypass flow between the cavity and the process chamber, and an exhaust valve located at a distance from the bypass valve and proximate to the cavity. The gas flow is conditioned within the cavity and delivered from the cavity.

DETAILED DESCRIPTION OF THE INVENTION

The present invention relates to the integration of a TMP with the associated bypass line and valves so that a single sub-assembly is created. In effect, the housing of the TMP is significantly modified to accommodate the associated equipment necessary for constructing a high-vacuum system. This single integrated high-vacuum pumping system addresses the key concerns required in designing and operating a high-vacuum system for general vacuum, semiconductor processing, and flat panel display screen manufacture.

To implement the invention, the strength of the housing and design of the housing are critical to a successful integration. For example, in the situation when a rotor breaks during operation of the TMP, large forces are generated as both internal pressure and torque on the housing of the TMP. The TMP housing design must withstand these pressures in addition to maintaining the integrity of the ancillary vacuum system components, which have now been integrated within the housing. This improved housing is one source of the integration.

This invention is therefore directed towards improvements in the high-vacuum systems often used in semiconductor and flat-panel production, as well as other applications where a high-vacuum system incorporating a TMP is required. In all applications involving a TMP, due to the physical nature of the TMP, a bypass system is required. This invention incorporates the bypass vacuum system and attendant valves into a single unit that addresses and improves upon many factors related to the use and operation of a high-vacuum system.

Figure 1:
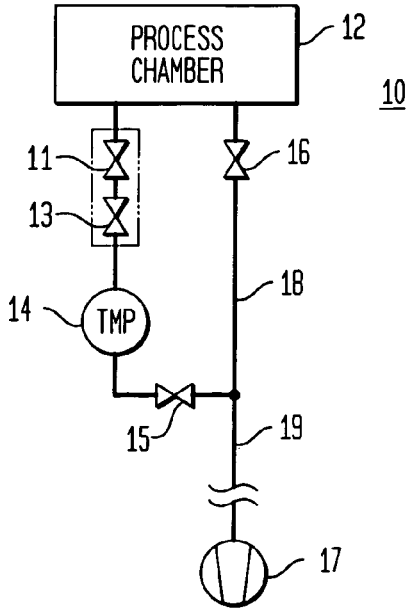
FIG. 1 (PRIOR ART)
FIG. 1 is a schematic representation of a known TMP system with associated valves and bypass system.

FIG. 1 shows a schematic representation of a known typical high-vacuum system 10 with TMP 14 in fluidic contact with the process chamber 12. The system further comprises a first inlet valve 11, a second inlet valve 13, exhaust valve 15 and foreline 19, eventually exhausted through pump 17. Also in connection with the chamber 12 is bypass valve 16, and bypass vacuum line 18. It is conventional for some applications to heat all of these elements to prevent condensation of the gases being pumped. The pump 14, however, may also have cooling, primarily to cool the motor used to run the pump.

According to the present invention, valves 11 and 13 can be combined. In almost all cases, some form of vacuum isolation is required of either valve 11 or valve 13. In most cases, some form of conductance varying valve (throttling valve) is used. The order of the valves in fluidic connection with the 12 is chosen by the engineer designing the system and is somewhat arbitrary. However, it is known for the two functions of the inlet valves to be combined in a single valve, for example a pendulum valve.

Figure 2:
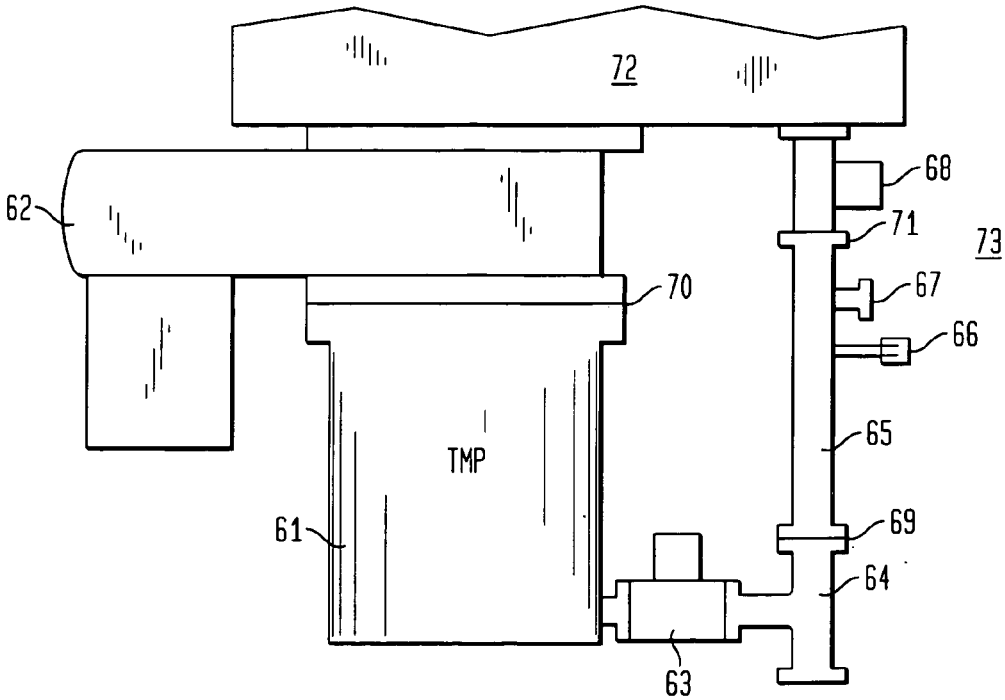
FIG. 2 (PRIOR ART)
FIG. 2 is a schematic representation of a known TMP system showing the key components that comprise a high-vacuum system used for semiconductor processing.

A representative known structure of the prior art is shown in FIG. 2. FIG. 2 shows the use of a single throttle/gate valve 62 in connection with chamber 72. The bypass valve 68 connects via seal 71 to a bypass line 65. Various fittings can be located on the bypass line. Such fittings could be an NW-style fitting 71 (one or more) and one or more VCR-type fittings 66. The number and type of fittings is selected according to the number and type of equipment to be connected to the bypass line 65.

Bypass line 65 is connected via a vacuum-tight seal 69 to a T-piece 64. This T-piece is further connected to bypass valve 63. The vacuum interfaces/seals shown in 69, 70, and 71 must be of high quality and require additional hardware (not shown), for example an O-ring and clamping, and/or bolts.

A known throttle/gate valve assembly 62 is designed to support the weight of the valve itself as well as the weight of the TMP. In one known arrangement, the bypass valve 68 is combined into the valve body housing. Although a potential savings results in terms of cost and footprint, it does not obviate the need for the other components of the vacuum system and stops short of a fully integrated solution.

Figure 3:
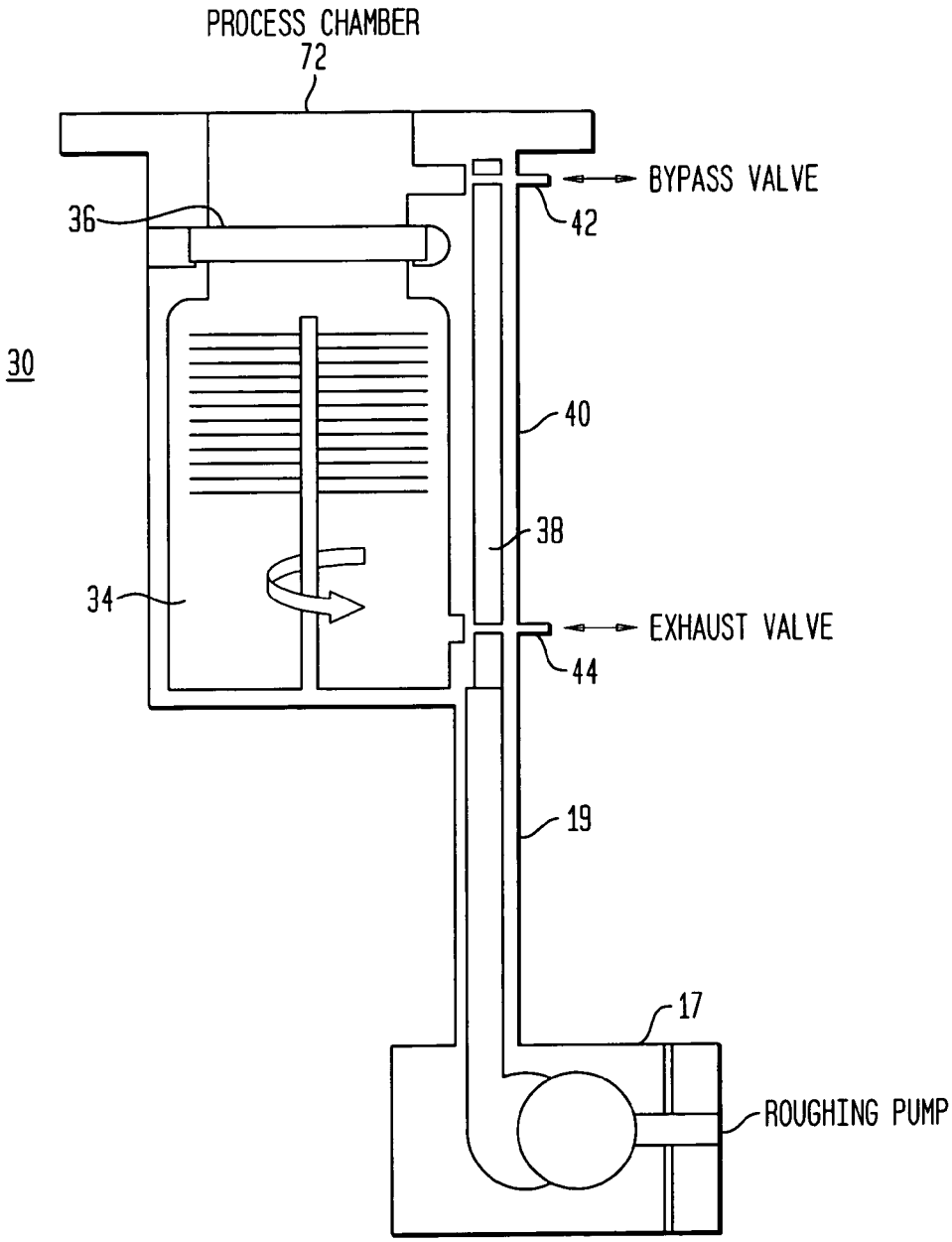
FIG. 3 is a schematic representation of one embodiment of the present invention showing the presence of the bypass and exhaust valves integrated into the body of the TMP.

By contrast, according to one embodiment of the present invention, all of the valves and bypass elements are incorporated into a single housing, as shown schematically in FIG. 3. In this system, the valve 62 in FIG. 2 is shown pictorially as feature 36. This valve 36 is integrated into the housing 40 of the TMP 34. The bypass valve 42, with entry port just above valve 36, can be located at the top of the bypass cavity 38. The exhaust valve 44 is shown at the end of the bypass cavity 38 and can be directly attached to the output of the TMP.

Figure 4:
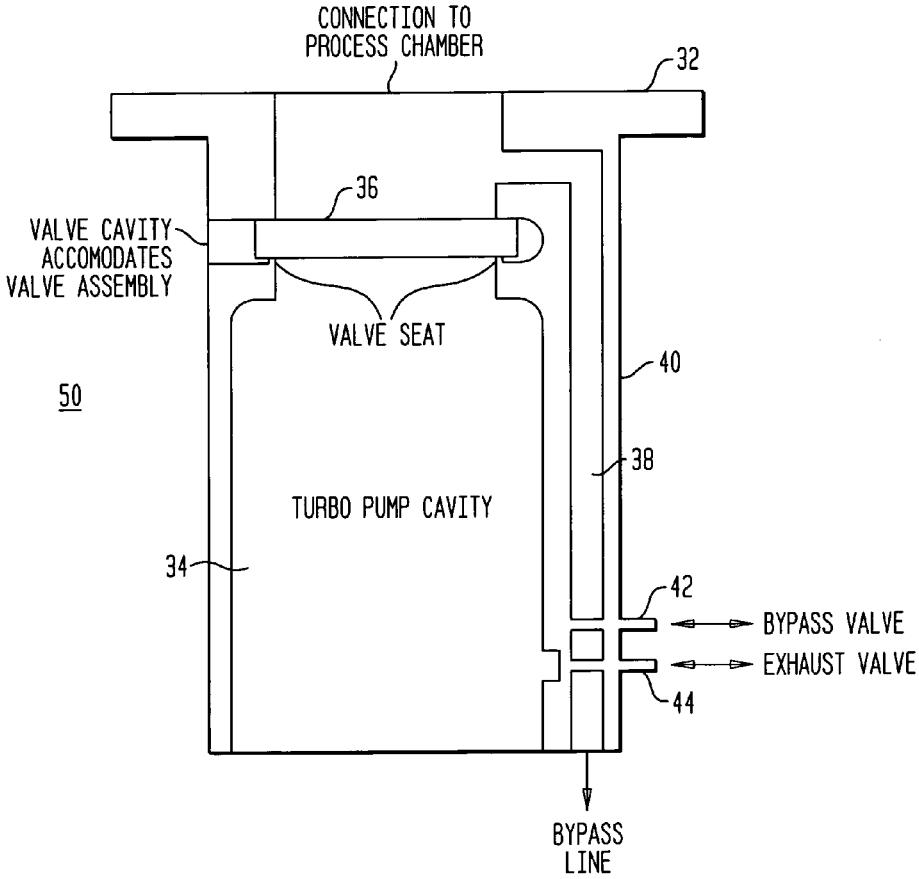
FIG. 4 is a schematic embodiment of the present invention that shows the exhaust valve and bypass valve located in close proximity to each other.

A schematic representation showing another embodiment of the present invention is shown in FIG. 4. This configuration 50 shows a bypass valve 42 and exhaust valve 44 in close proximity to each other. Due to the nature of the functions of the valves, valves 42 and 44 can be combined into a 3-way valve. In the 3-way valve case, the exhaust of the TMP is connected to the vacuum foreline, the bypass cavity 38 is connected to the foreline, or both the TMP and bypass cavity are isolated from the vacuum foreline.

Figure 5:
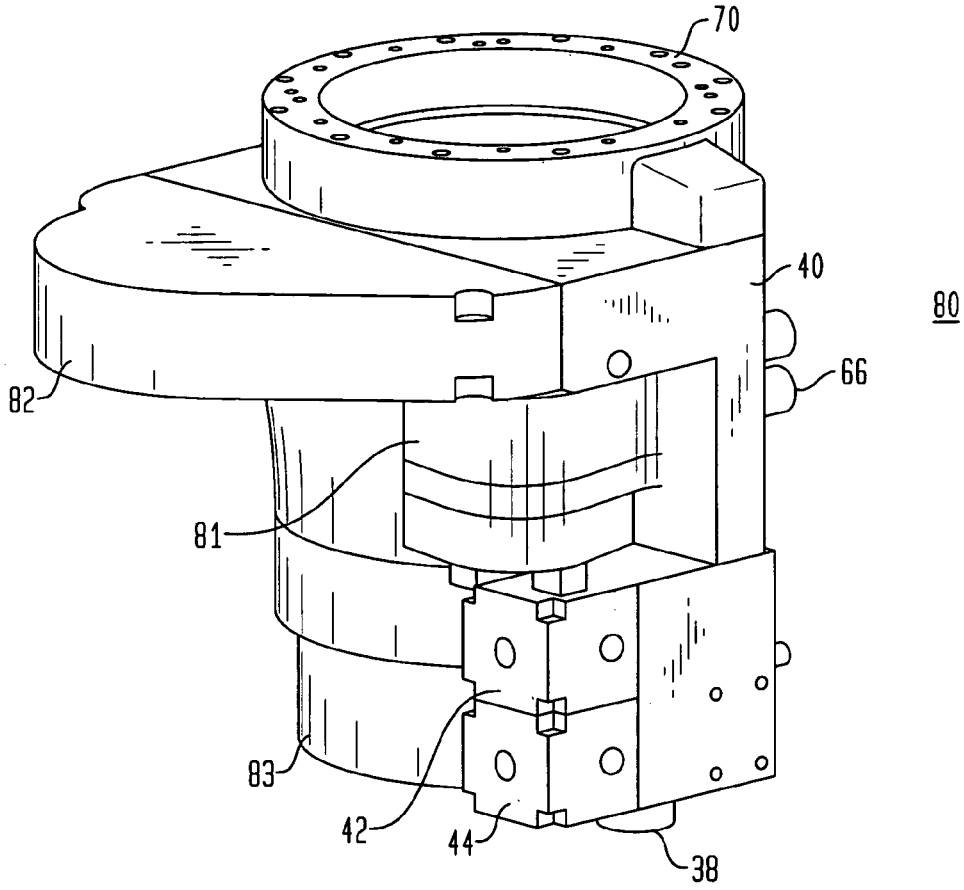
FIG. 5 is a perspective drawing of one embodiment of the present invention.

A further embodiment of the present invention is shown in the perspective drawing of FIG. 5. In configuration 80, the chamber vacuum interface 70 is clearly shown. The TMP housing 40, in two parts, combines the inlet valve 82, bypass valve 42, exhaust valve 44, and has fittings 66 attached. The housing is attached to the base of the TMP 83. The bottom of the bypass line (cavity) 38 is shown and would be connected to the foreline 19 (shown in FIG. 1). The valve assembly 82 also shows the presence of an access cover for maintenance and service of the inlet (throttle/gate) valve. A single assembly is thus formed. In this case, the inlet (throttle/gate) valve 62 is embedded into the housing of the TMP 38 and shown integrated as 82 whereby a housing is provided for access to the valve 62 for service. The bypass valve 42 and exhaust valve 44 are in close proximity to each other as shown in FIG. 4.

According to the present invention, the housing 40 and valves 42 and 44 are in thermal contact with each other. When heated, the bypass line 38, which is now a milling within the housing 40, valve housing 82, and valves 42 and 44 can reach a similar temperature. This helps to eliminate thermal differentials within the system that could cause particles to shed and migrate back to the process chamber. The temperature gradient present will depend on the thermal conduction of the housing material, (e.g. an aluminum alloy), and the thermal contact between the housing 40 and the valves 42 and 44. According to the present invention, one preferred useful alloy for the housing is an aluminum alloy. When properly designed, the aluminum alloy housing of the present invention will afford the assembly the appropriate strength as well as provide desirable thermal characteristics that will enable heat transfer throughout the assembly such that no significant temperature differentials exists. In the most preferred embodiment, the alloy selection and the design contribute to a thermal differential throughout the assembly of less than about 1° C.

Figure 6:
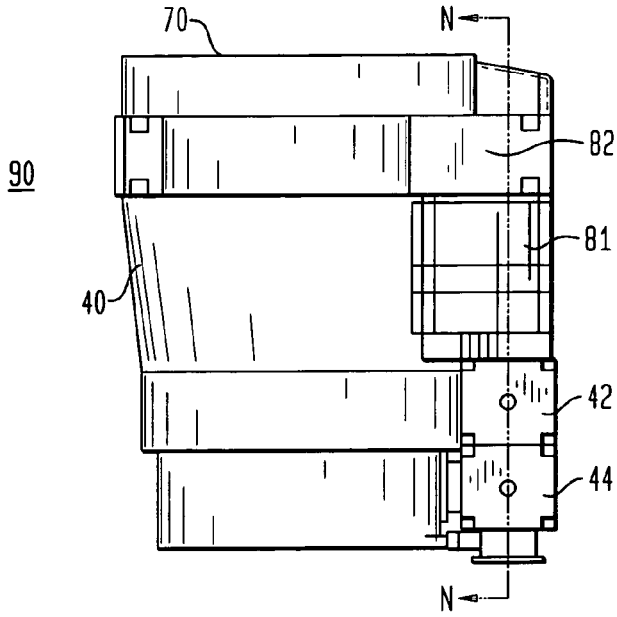
FIG. 6 is a side view of FIG. 5 with a section N—N illustrated for later reference.
Figure 7:
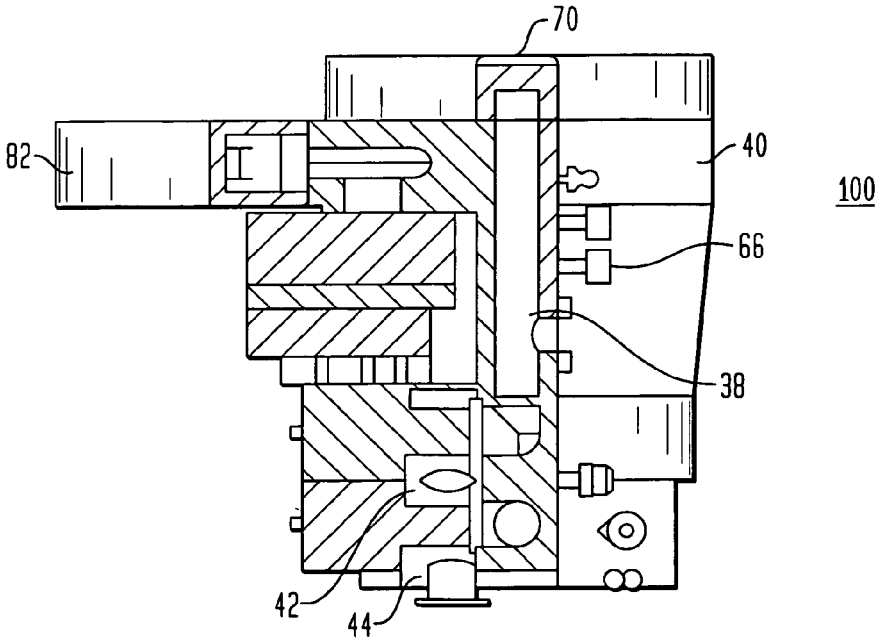
FIG. 7 is a cross-sectional drawing of the section N—N shown in FIG. 5.

A side view of one embodiment of this invention is shown in FIG. 6. This figure shows a section N—N. This section is shown in detail in FIG. 7. In this section, the bypass cavity 38 is clearly seen within the housing 40. The housing has channels drilled/machined into it for the bypass cavity 38 and valves 42 and 44. The interface to the chamber 70 is shown at the top of the figure. As can be seen, there are a multitude of fittings 66 shown. Moreover, valves 42 and 44 are shown with bellows mechanisms. Other types of mechanisms can also be used.

Figure 8:
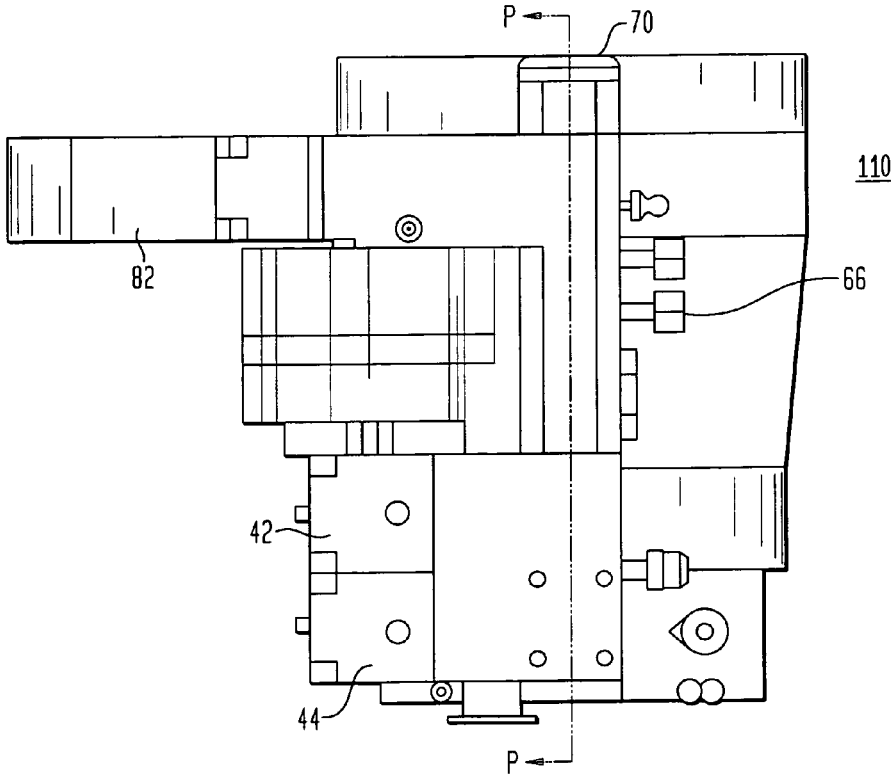
FIG. 8 is a side view of FIG. 5 illustrating a section P—P for future reference.

FIG. 8 shows a different planar projection of FIG. 5 with section P—P illustrated. Section P—P is shown in detail in FIG. 9. Again the bypass cavity 38 is clearly visible as well as its connection to the top of valve 82. Passageways 122 and 123 are formed by machining/drilling. These passageways support flow through the bypass 38 and valves 42 and 44. The base of the TMP is shown in cross-section as 121. The housing 40 has a cavity 122 in which the TMP stator and rotor elements can be fitted.

Figure 9:
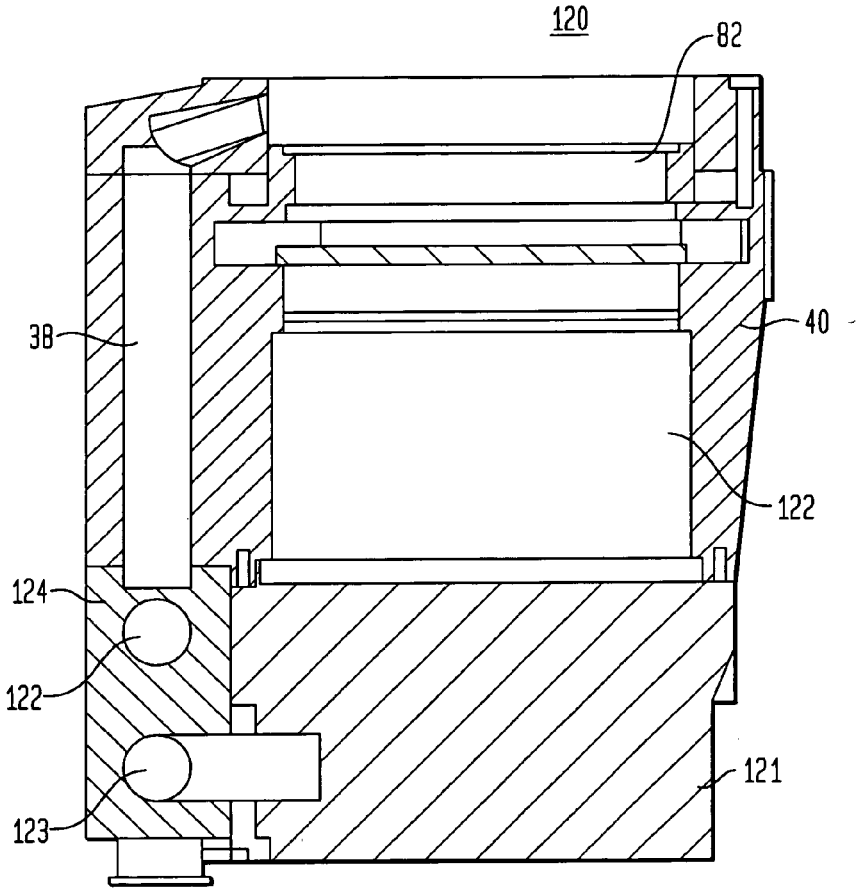
FIG. 9 is a cross-sectional view of the section P—P in FIG. 8.

In FIG. 9 a valve housing 123 is shown whereby valves 42 and 44 can be combined into a single housing. This housing is connected to the TMP housing 40 as well as to the exhaust of the TMP.

Figure 10:
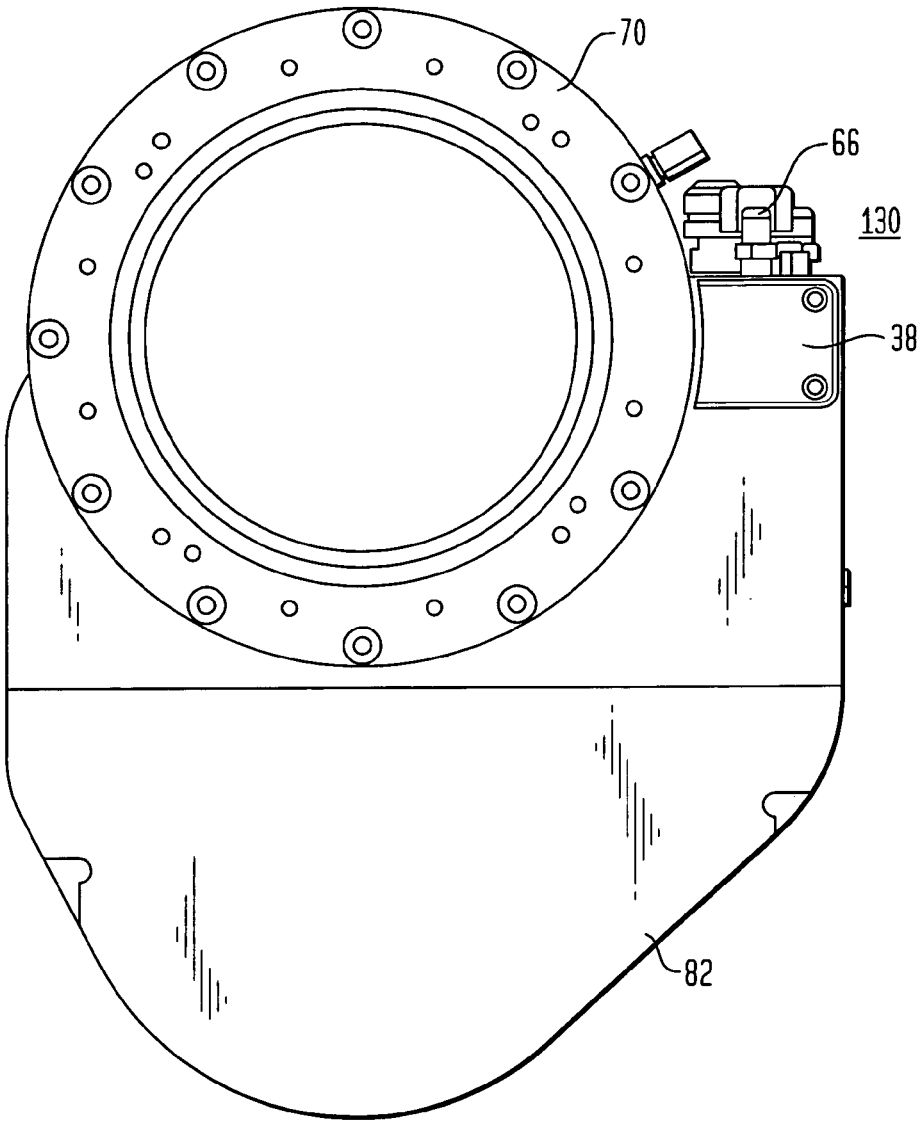
FIG. 10 is an overhead plan view of FIG. 5 showing the compact nature of the integrated system of the present invention.

FIG. 10 shows an overhead pan view of FIG. 5. The fittings 66 are shown as well as the top of the bypass cavity 38. In this case, a lid is fit to the top of 38 to provide for ease in machining the bypass cavity 38. The lid has a vacuum seal. The footprint of the system is reduced from that of the system in FIG. 2 by virtue of the location of the bypass 38 and the extension of it from the outside of the TMP. Therefore, an improved compact design is achieved.

The design of the TMP housing 40 is important. The housing must be durable enough to withstand the destructive force that may occur in the event of the rotor bursting during normal operation. A conventional valve housing 62 (e.g. shown in FIG. 2) is not designed with these destructive forces in mind, due to the functional requirements of the housing. By contrast, according to the present invention, because a single housing is used, the problems associated with a rotor burst are confined to a single unit. This allows for optimizations in the design that can affect the amount of torque transmitted to the upper chamber interface. An improved single design also allows for the incorporation of other torque reducing features such as crumple-zones or break-away components within the housing. Moreover, one of the key requirements for safety in the event of rotor destruction is maintaining vacuum integrity. This is more easily achieved with all elements combined in a single housing, so that all can be considered in the pursuit of an optimum design.

By virtue of combining the necessary vacuum elements into a single design, all of the vacuum components can be carefully selected and easily tested as a single unit. This is not the case in the conventional supply of the vacuum components. Moreover, according to the present invention, in the case of a failure, diagnostics of the single components is not necessary in situ when in use for process. Instead, the entire vacuum sub-assembly can be replaced. This reduces the amount of inoperable time associated with troubleshooting of a complicated system. Instead, the careful troubleshooting can be performed in a special dedicated location and make use of special equipment for testing and diagnosis. This is an important aspect especially considering the conventional application in semiconductor processing and flat-panel processing. In these applications, any time saved during troubleshooting directly impacts the profitability of the company. A fast replacement time with a known good sub-assembly/system can be very cost advantageous.

It is worth noting that the combination of the elements in the prior art into the TMP housing/structure is not obvious due to the effort required to design a TMP housing without integration. The housing design is a special field of expertise where expert analysis and detailed modeling of the strength of the housing is required. Yet, the integration offers compactness and ease of use for the user of the high-vacuum system.

In other embodiments of the invention, the inlet (throttle/gate) valve assembly 82 may perform only gating functions, or be eliminated altogether. If conductance variation is required, the valve assembly 82 may be replaced with a smaller diameter assembly and be integrated at the exhaust point 38 of the housing.

In a different embodiment, the exhaust valve 44 may perform the throttling function of valve 82 by using a variable conductance valve for valve 44.

A controlled evacuation of the vacuum chamber may also be achieved by using a variable conductance valve as the bypass valve. Moreover, valve 44 may be augmented with a very small, additional valve, to perform a soft-start function whereby the chamber is evacuated through an additional slow, narrow bypass pipe that circumvents the exhaust valve 44.

Many modifications, variations, and other embodiments of the invention will come to the mind of one skilled in the art to which this invention pertains having the benefit of the teachings presented in the foregoing descriptions. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. An integrated vacuum pumping system for gas delivery comprising:

a housing with integral flange for connection to a process chamber;

a cavity within said housing, said cavity comprising a turbo-molecular pump;

an inlet valve integrated into the housing and moveably connected to the housing, said inlet valve located within said cavity at a position between the turbo-molecular pump and the process chamber;

a bypass line integrally located within the housing, said bypass line in valved communication with the cavity at a plurality of locations along the bypass line, with at least one location being located on either side of the inlet valve;

a bypass valve integrally located within the bypass line for regulating bypass flow between the cavity and the process chamber; and an exhaust valve located integrally within the housing at a distance from the bypass valve and proximate to the cavity.

2. An apparatus for delivering gas comprising:

a housing with integral flange for connection to a process chamber;

a cavity integrated within the housing, said cavity comprising a turbo-molecular pump;

an inlet valve integrated within the housing and moveably connected to the housing, said inlet valve located within said cavity at a position between the turbo-molecular pump and the process chamber;

a bypass line integrally located within the housing, said bypass line in valved communication with the cavity at a plurality of locations along the bypass line, with at least one location being located on either side of the inlet valve;

a bypass valve located within the bypass line for regulating bypass flow within said bypass line between the cavity and the process chamber; and an exhaust valve for regulating flow from the cavity to the bypass line, said exhaust valve located proximate to said bypass valve.

3. The apparatus of claim 2, wherein the bypass valve and exhaust valve are combined into a three-way valve.

4. The apparatus of claim 2, wherein the exhaust valve is attached to the turbo-molecular pump outlet.

5. The apparatus of claim 2, wherein the housing is connected to the base of the turbo-molecular pump.

6. The apparatus of claim 2, wherein the housing and the valves are in thermal contact with each other.

7. The apparatus of claim 2, wherein the bypass line is a milling within the housing.

8. The apparatus of claim 1, wherein the inlet valve is selected from the group consisting of a gate valve, a throttle valve, and a combination gate/throttle valve.

9. The apparatus of claim 2, wherein the housing, the inlet valve, bypass valve, exhaust valve and by pass line are maintained at substantially similar temperatures during operation.

10. The apparatus of claim 2, wherein the housing is dimensioned and constructed to contain fractured segments of the turbo-molecular pump in the event of pump failure.

11. A method for delivering gas comprising the steps of:

directing a flow from a source to an apparatus for delivering gas, said apparatus comprising:

a housing with integral flange for connection to a process chamber;

a cavity within said housing, said cavity comprising a turbo-molecular pump;

an inlet valve integrated into the housing and moveably connected to the housing, said inlet valve located within said cavity at a position between the turbo-molecular pump and the process chamber;

a bypass line integrally located within the housing, said bypass line in valved communication with the cavity at a plurality of locations along the bypass line, with at least one location being located on either side of the inlet valve;

a bypass valve located within the bypass line for regulating bypass flow between the cavity and the process chamber;

an exhaust valve located at a distance from the bypass valve and proximate to the cavity;

conditioning the flow within the cavity; and delivering the flow from the cavity.

12. A method for delivering gas comprising the steps of:

directing a flow from a source to an apparatus for delivering gas, said apparatus comprising:

a housing with integral flange for connection to a process chamber;

a cavity within said housing, said cavity comprising a turbo-molecular pump;

an inlet valve integrated into the housing and moveably connected to the housing, said inlet valve located within said cavity at a position between the turbo-molecular pump and the process chamber;

a bypass line integrally located within the housing, said bypass line in valved communication with the cavity at a plurality of locations along the bypass line, with at least one location being located on either side of the inlet valve;

a bypass valve located within the bypass line for regulating bypass flow within said bypass line between the cavity and the process chamber; and an exhaust valve for regulating flow from the cavity to the bypass line, said exhaust valve located proximate to said bypass valve;

conditioning the flow within the cavity; and delivering the flow from the cavity.

* * * * *